US008764153B2

(12) United States Patent
Sanada

(10) Patent No.: US 8,764,153 B2
(45) Date of Patent: Jul. 1, 2014

(54) INKJET RECORDING APPARATUS AND IMAGE FORMING METHOD

(75) Inventor: Kazuo Sanada, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 173 days.

(21) Appl. No.: 13/283,832

(22) Filed: Oct. 28, 2011

(65) Prior Publication Data

US 2012/0105532 A1 May 3, 2012

(30) Foreign Application Priority Data

Oct. 29, 2010 (JP) ..... 2010-244672

(51) Int. Cl.
*B41J 29/38* (2006.01)
*B41J 2/01* (2006.01)

(52) U.S. Cl.
USPC ..... 347/16; 347/102

(58) Field of Classification Search
USPC ..... 347/16, 102
See application file for complete search history.

(56) References Cited

U.S. PATENT DOCUMENTS

| | | | |
|---|---|---|---|
| 7,600,867 | B2 | 10/2009 | Mills et al. |
| 2010/0182378 | A1 | 7/2010 | Mitsuzawa |
| 2011/0310204 | A1 | 12/2011 | Ohnishi |

FOREIGN PATENT DOCUMENTS

| | | | | |
|---|---|---|---|---|
| JP | 2005-104108 | A | | 4/2005 |
| JP | 2005-254560 | A | | 9/2005 |
| JP | 2005254560 | A | * | 9/2005 |
| JP | 2005-313445 | A | | 11/2005 |
| JP | 2010-099895 | A | | 5/2010 |
| JP | 2010099895 | A | * | 5/2010 |
| JP | 2010-155385 | A | | 7/2010 |
| JP | 2010-167678 | A | | 8/2010 |
| JP | 2010-195002 | A | | 9/2010 |
| WO | WO 2005/032827 | A1 | | 4/2005 |

* cited by examiner

*Primary Examiner* — Jason Uhlenhake
(74) *Attorney, Agent, or Firm* — Birch, Stewart, Kolasch & Birch, LLP

(57) ABSTRACT

An inkjet recording apparatus includes: an inkjet head having nozzles which eject ink onto a recording medium, the ink being curable by irradiation of an active light beam; a relative movement device recording medium; an active light beam irradiation device having an active light beam emission unit that emits the active light beam and is divided into units in a direction of the relative movement for irradiating the ink deposited on the recording medium with the active light beam while relative movement between the recording medium and the active light beam irradiation device is caused along with the inkjet head; and an active light beam irradiation control device which controls on or off switching with respect to each of the divided units.

10 Claims, 15 Drawing Sheets

INKJET RECORDING APPARATUS AND IMAGE FORMING METHOD

BACKGROUND OF THE INVENTION

1. Field of the Invention

The present invention relates to an inkjet recording apparatus and an image forming method, and more particularly, to an image forming technology using ultraviolet-curable ink.

2. Description of the Related Art

An inkjet recording apparatus which forms a desired image on a recording medium by ejecting color ink from an inkjet head is known as a general image forming apparatus. In recent years, non-permeable (low-permeability) media, such as resin, film have been used, in addition to media having permeability, such as paper, and apparatuses which cure ink deposited on a medium by means of irradiation of ultraviolet light as active light have been proposed. An ultraviolet-curable ink used in these apparatuses contains a photoinitiator having prescribed sensitivity with respect to ultraviolet light.

In an inkjet recording apparatus which uses ultraviolet-curable ink, a light source for irradiating ultraviolet light is mounted on a carriage on which an inkjet head is installed, the ultraviolet light source is caused to be scanned so as to follow the inkjet head, and ultraviolet light is irradiated onto ink droplets immediately after landing on a medium, thereby preventing positional displacement of the ink droplets.

Japanese Patent Application Publication No. 2005-104108 discloses an inkjet recording apparatus in which a plurality of ultraviolet light sources are arranged in a direction (a nozzle arrangement direction) perpendicular to a reciprocating direction of a head, and the ultraviolet brightness distribution on the medium is made uniform, so as to prevent the occurrence of density non-uniformities. Furthermore, Japanese Patent Application Publication No. 2005-313445 discloses an inkjet recording apparatus in which an ultraviolet light irradiation apparatus is provided on either side of a recording head in a main scanning direction, and an ultraviolet light irradiation apparatus is also provided on the downstream side of a recording medium conveyance direction, in such a manner that even if ultraviolet light irradiation apparatuses of a low-output type are used, a sufficient amount of ultraviolet light for curing the ink can be obtained.

Moreover, U.S. Pat. No. 7,600,867 discloses an ultraviolet-curing type of print system in which curing light sources arranged on either side in a main scanning direction of an inkjet head are composed movably on the downstream side of the conveyance direction of the recording medium.

However, in cases where the type of medium is paper or vinyl chloride resin, or the like, and is in the form of a roll, cases where an image is formed up to the outer edges of the medium (cut sheet) (excluding cases where the image formation area is restricted to inside the medium), cases where an image is formed onto a medium of large thickness, or cases where an image is formed on a solid object (undulating surface), there is a possibility that ultraviolet light will be irradiated onto positions outside the ink deposition positions, and be reflected in unexpected directions.

FIG. 15 shows a schematic drawing of a state where image formation is carried out by ejecting ink from an inkjet head 204 onto a rigid medium 202 having a projecting surface 200. As shown in FIG. 15, ultraviolet light sources 206, 208 are provided on either side of the main scanning direction of the inkjet head 204, and when forming an image in the main scanning direction while scanning (moving) the inkjet head 204 and the ultraviolet light sources 206 and 208 along a guide 210, if ultraviolet light is radiated onto an inclined surface (edge of a projecting section) 214 on the outer edge of the image formation area 212 of the medium 202, then the ultraviolet light is radiated onto unexpected locations where the ultraviolet light is not originally supposed to be irradiated, which is undesirable from a safety viewpoint.

In FIG. 15, the direction of irradiation of the ultraviolet light is indicated by the arrow 216, and the direction of reflection of the ultraviolet light is indicated by the arrow 218; the ultraviolet light is irradiated to the outside of the image formation area 212. In the technology disclosed in Japanese Patent Application Publication No. 2005-104108, Japanese Patent Application Publication No. 2005-313445 and U.S. Pat. No. 7,600,867, it is extremely difficult to prevent irradiation of ultraviolet light onto unexpected locations in this way.

SUMMARY OF THE INVENTION

The present invention has been contrived in view of these circumstances, an object thereof being to provide an inkjet recording apparatus and an image forming method whereby irradiation of ultraviolet light onto unexpected locations is prevented and safe image formation is achieved.

In order to achieve an aforementioned object, one aspect of the present invention is directed to an inkjet recording apparatus comprising: an inkjet head having nozzles which eject ink onto a recording medium, the ink being curable by irradiation of an active light beam; a relative movement device which causes relative movement between the inkjet head and the recording medium; an active light beam irradiation device having an active light beam emission unit that emits the active light beam and is divided into units in a direction of the relative movement for irradiating the ink deposited on the recording medium with the active light beam while relative movement between the recording medium and the active light beam irradiation device is caused along with the inkjet head; and an active light beam irradiation control device which controls on or off switching with respect to each of the divided units of the active light beam emission unit in terms of an alignment sequence of the divided units in the direction of the relative movement, and switches on the divided units of the active light beam emission unit sequentially in order of reaching an image formation area on the recording medium, and switches off the divided units of the active light beam emission unit sequentially in order of leaving the image formation area.

Another aspect of the present invention is directed to an image forming method comprising: an ink ejection step of ejecting ink from nozzles onto a recording medium while causing relative movement between the recording medium and an inkjet head having the nozzles for ejecting the ink that is curable by irradiation of an active light beam; and an active light beam irradiation step of irradiating the ink which has been deposited onto the recording medium with the active light beam emitted from an active light beam emission unit divided into units in a direction of the relative movement while relative movement between the recording medium and the active light beam emission unit is caused along with the inkjet head in such a manner that when the ink deposited on the recording medium is irradiated with the active light beam, switching on or off the active light beam irradiation unit is performed with respect to each of the divided units sequentially in order of an alignment sequence in the direction of the relative movement, and the switching on the divided units of the active light beam emission unit is performed sequentially in order of reaching an image formation area on the recording medium and the switching off the divided units of the active light beam emission unit is performed sequentially in order of leaving the image formation area.

According to the present invention, divided units of an active light beam emission unit having a structure divided in the relative movement direction of an inkjet head are controlled on or off in the alignment sequence, the divided units being switched on in sequence of arriving at an image formation area and being switched off in sequence of leaving the image formation area, and therefore an active light beam is radiated only onto the image formation area and irradiation of the active light beam in unexpected directions or onto unexpected regions is suppressed.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

Figure 8:
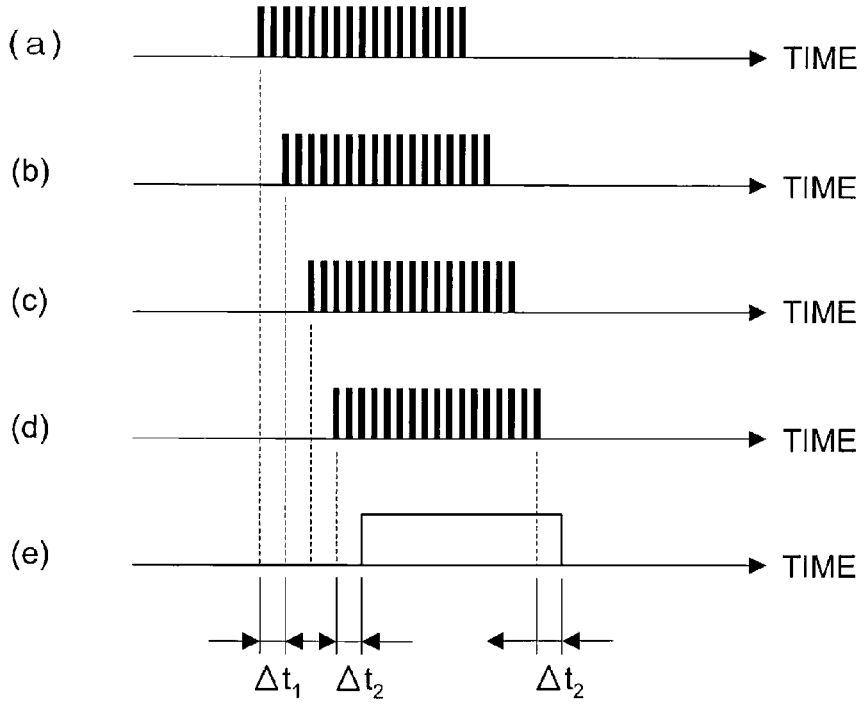
Figure 9:
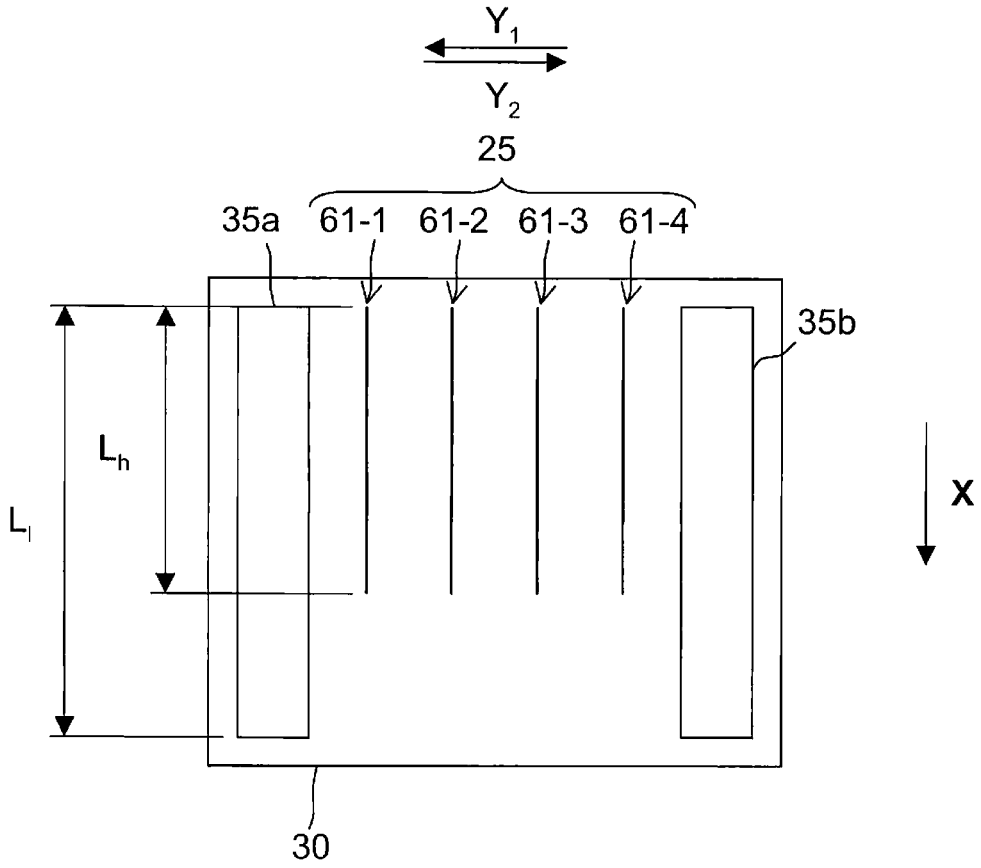
Figure 10:
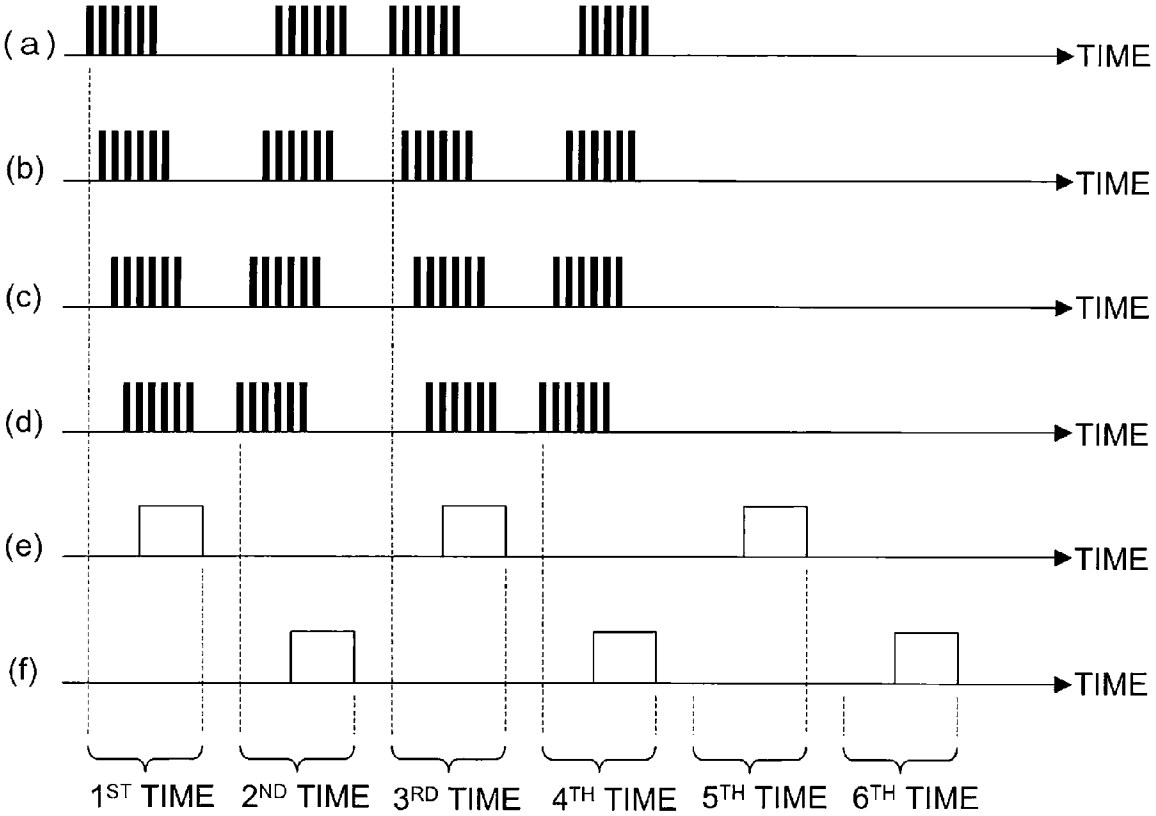
Figure 11:
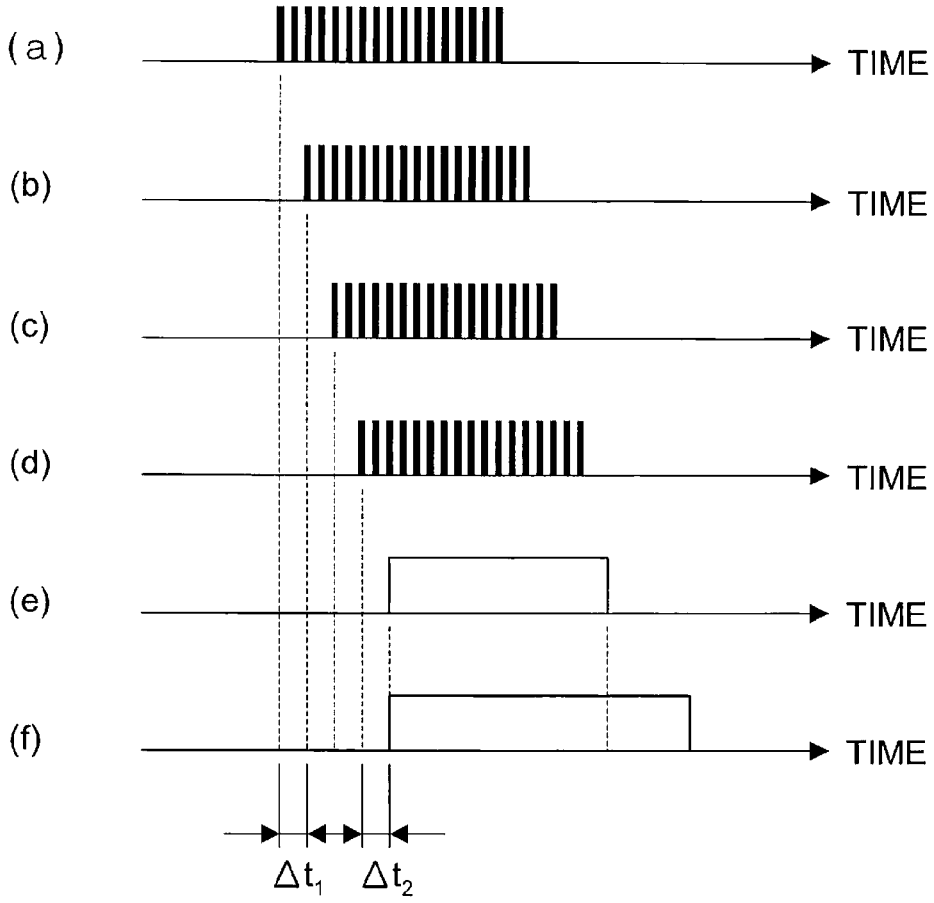
Figure 12:
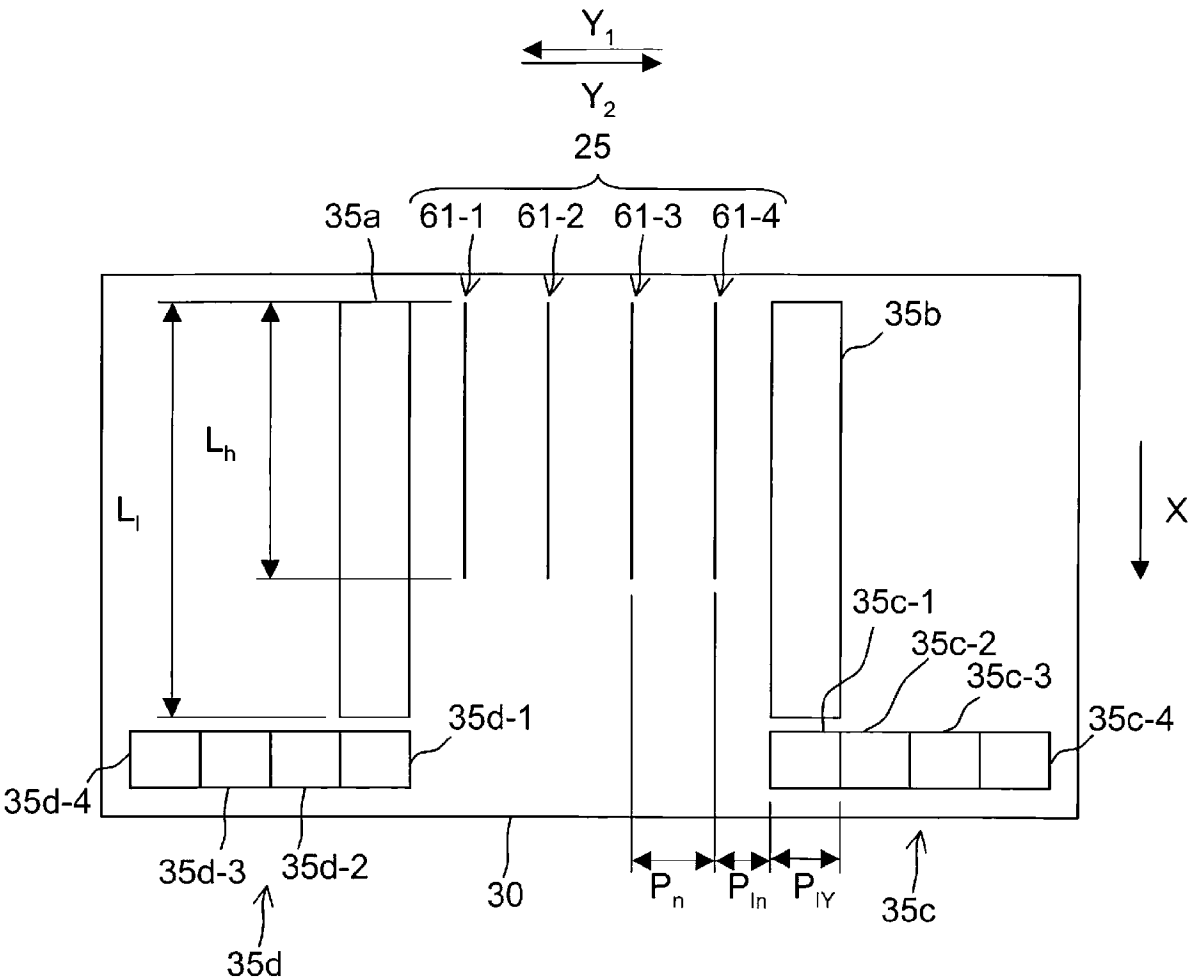
Figure 13:
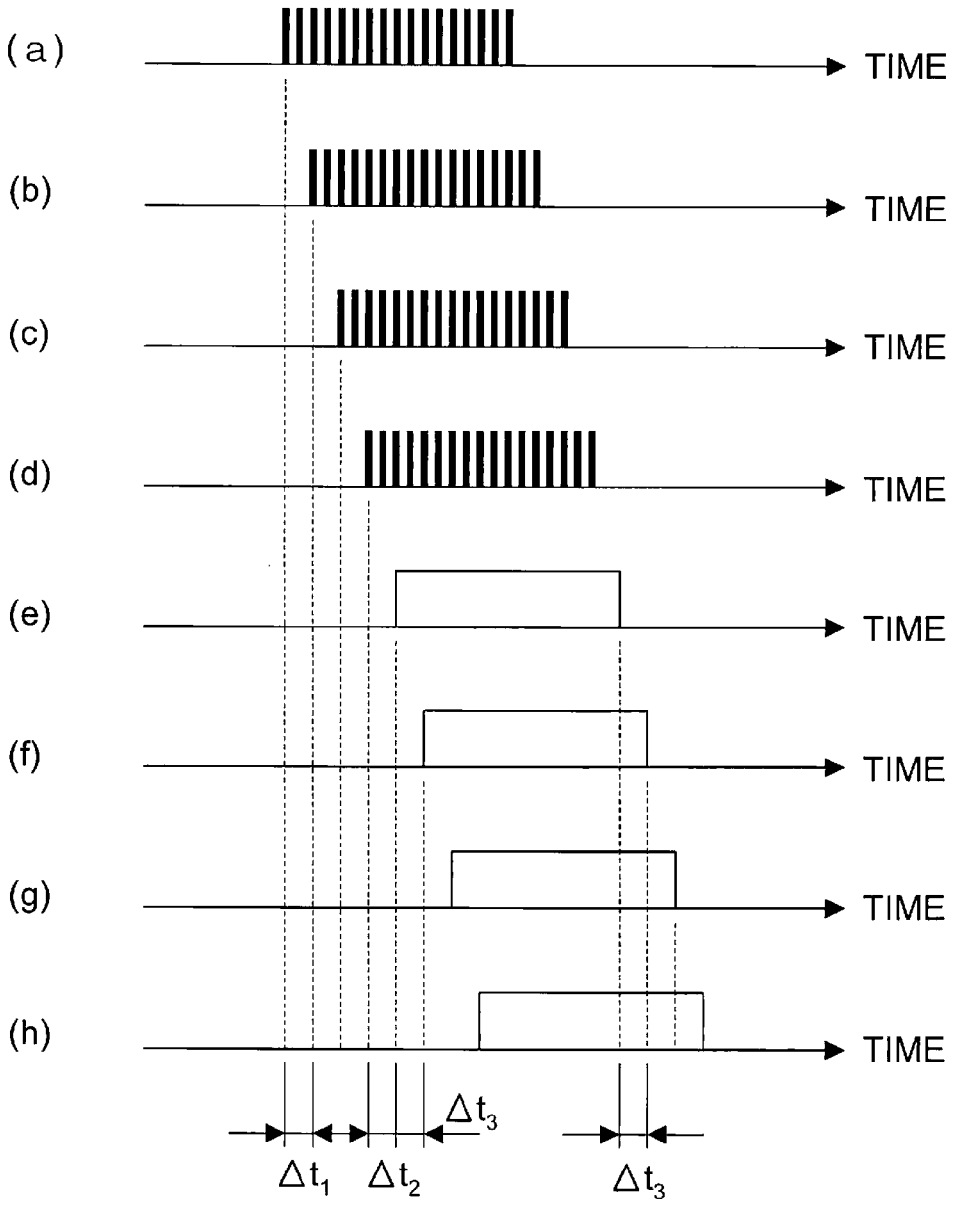
Figure 14:
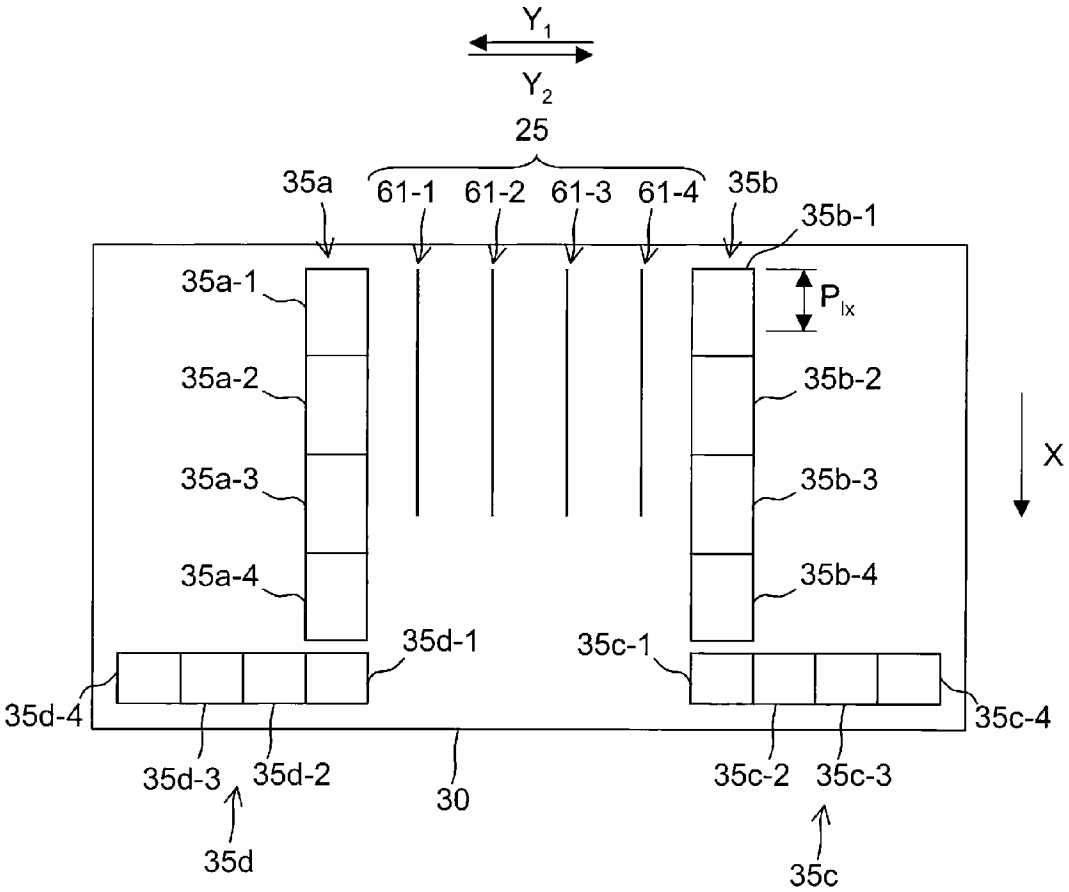
Figure 15:
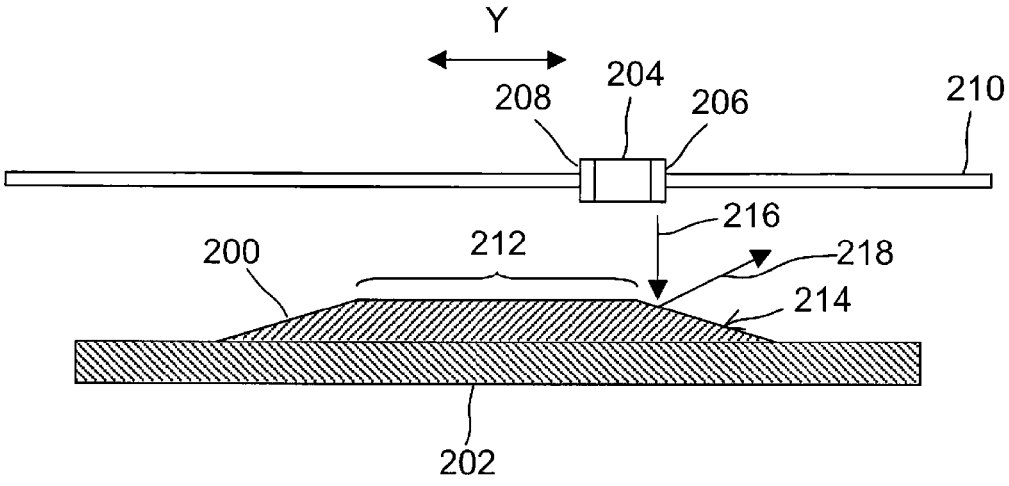
FIG.15 RELATED ART

(*a*) to (*e*) of FIG. 8 are illustrative diagrams showing a relationship between the ejection timing of an inkjet head in the main scanning direction and the irradiation timing of ultraviolet light for provisional curing;

FIG. 9 is an illustrative diagram showing the positional relationship of nozzle rows and ultraviolet light irradiation units for provisional curing;

(*a*) to (*f*) of FIG. 10 are illustrative diagrams showing a relationship between the ejection timing of an inkjet head in the sub-scanning direction and the irradiation timing of ultraviolet light for provisional curing;

(*a*) to (*f*) of FIG. 11 are diagrams showing problems in the ejection timing of an inkjet head and the irradiation timing of ultraviolet light for main curing;

FIG. 12 is an illustrative diagram showing a positional relationship of nozzle rows and ultraviolet light irradiation units for main curing;

(*a*) to (*h*) of FIG. 13 are illustrative diagrams showing a relationship between the ejection timing of an inkjet head in the main scanning direction and the irradiation timing of ultraviolet light for main curing;

FIG. 14 is an illustrative diagram showing a further mode of an ultraviolet light irradiation unit for provisional curing shown in FIG. 12; and FIG. 15 is an illustrative diagram of problems relating to the related art.

DETAILED DESCRIPTION OF THE PREFERRED EMBODIMENTS

General Composition of Inkjet Recording Apparatus

Figure 1:
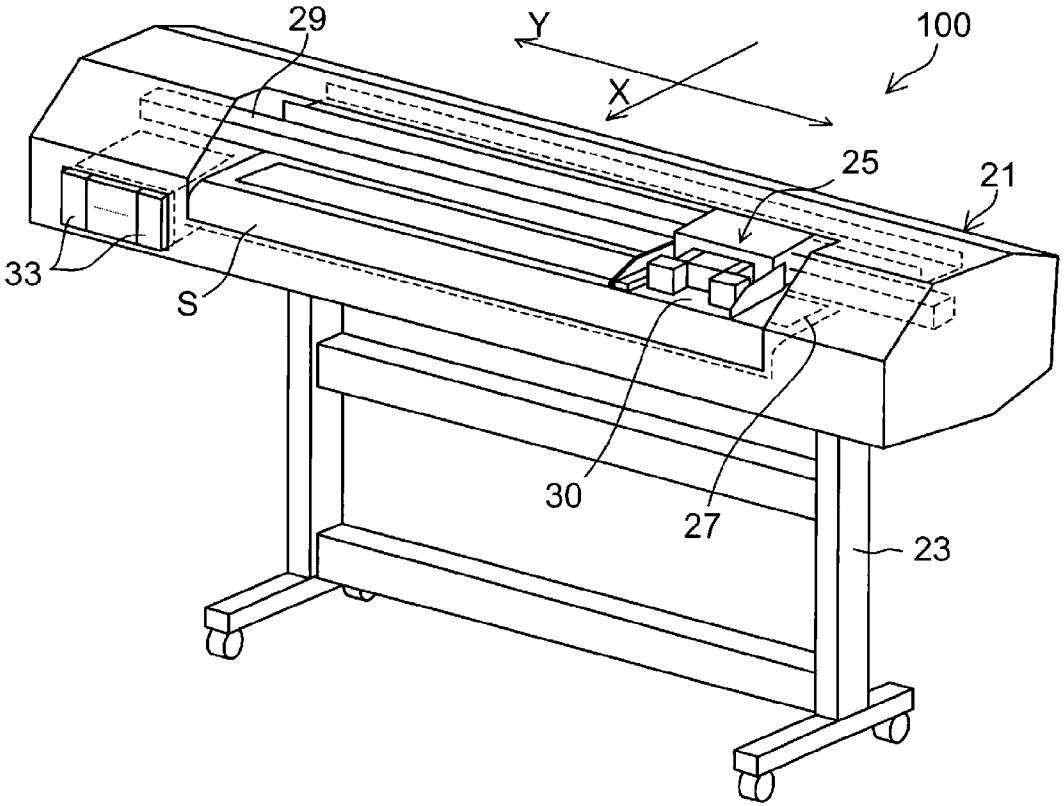
FIG. 1 is an external perspective drawing of an inkjet recording apparatus relating to an embodiment of the present invention.

FIG. 1 is an external perspective drawing of an inkjet recording apparatus relating to an embodiment of the present invention. This inkjet recording apparatus 100 is a wide-format printer which records onto a broad image formation range, such as large posters or commercial wall advertisements, or the like, and the inkjet recording apparatus 100 includes an apparatus main body 21 and a stand 23 which supports this apparatus main body 21. Here, a printer corresponding to a medium of super A3 size (size of A3 with a predetermined margin) or greater is called a "wide format".

The apparatus main body 21 includes an inkjet head 25 of a multi-channel type and a fixed platen 27. The inkjet head 25 is mounted on a carriage 30 which moves reciprocally in a scanning direction (main scanning direction) Y that is perpendicular to the recording medium conveyance direction (sub-scanning direction) X, along a guide mechanism 29 which is a head movement device (scanning device).

The platen 27 shown in FIG. 1 is formed in an inverted gutter shape and the upper surface thereof is a supporting surface for a recording medium S. A pair of scanning conveyance rollers, which form a recording medium conveyance device (not shown in FIG. 1 and labelled with reference numeral 43 in FIG. 2) are arranged on the upstream side in the recording medium conveyance direction X in the vicinity of the platen 27, and this pair of scanning conveyance rollers cause the recording medium S to move in the recording medium conveyance direction X on the platen 27. The pair of scanning conveyance rollers grip only the end portions of the recording medium in the width direction, and prevent interference with the opening and closing lid of the platen 27 by constricting the diameter of the central portion of the recording medium S. The inkjet head 25 is moved in a scanning direction Y which is parallel to a supporting surface of the platen 27 and perpendicular to the recording medium conveyance direction X, by a guide mechanism 29.

An ink cartridge installation section (not illustrated) for installing replaceable cartridges 33 which store ink is provided on the left-hand front surface of the apparatus main body 21 when viewed from the front side. The cartridges 33 are provided so as to correspond to respective inks which are used in the inkjet recording apparatus 100 of the present example. The cartridges 33 are connected to the inkjet head 25 by ink supply channels (not illustrated) which are formed independently, and the cartridges 33 are replaced when the remaining amount of ink of the respective colors has become low.

The inkjet recording apparatus 100 according to the present embodiment employs an ultraviolet-curable ink (UV ink). It is possible to change the type of ink by changing the cartridges 33.

Although not shown in the drawings, a maintenance unit for the inkjet head 25 is provided on the right-hand side of the apparatus main body 21 as viewed from the front side. This maintenance unit includes a cap for keeping the inkjet head 25 moist when not printing, and a wiping member (blade, web, etc.) for cleaning the nozzle surface (ink ejection surface) of the inkjet head 25. The cap which caps the nozzle surface of the inkjet head 25 is provided with an ink receptacle for receiving ink droplets ejected from the nozzles for the purpose of maintenance.

The inkjet recording apparatus 100 includes an elevator device comprising a screw mechanism, or the like, which raises and lowers the inkjet heads 25 vertically with respect to the platen 27. The inkjet head 25 is lifted from and lowered to the platen 27 in accordance with the thickness of the recording medium S mounted on the platen 27.

Description of Paper Conveyance Path

Figure 2:
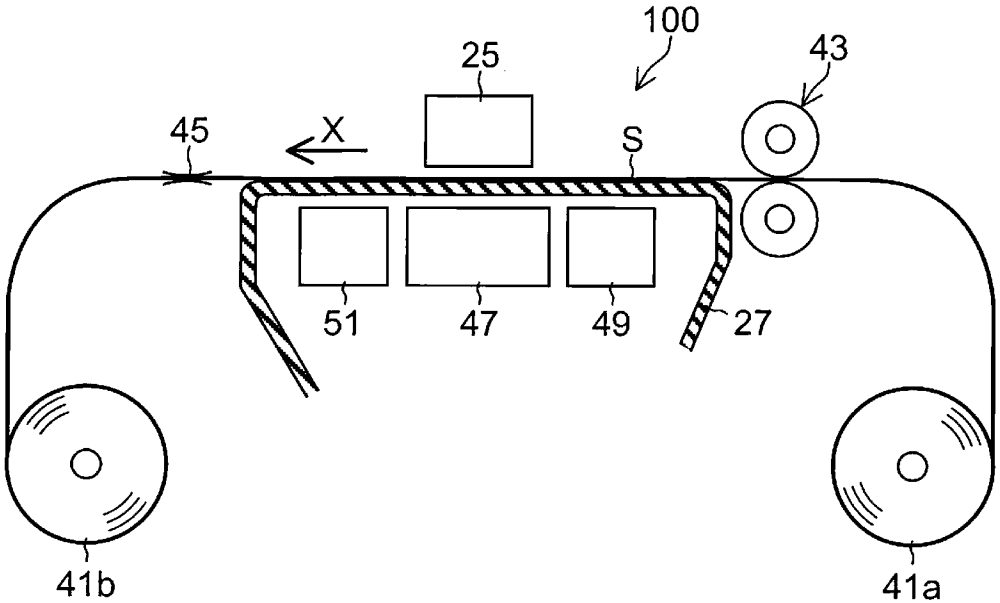
FIG. 2 is an illustrative diagram which shows a schematic drawing of a paper conveyance path in the inkjet recording apparatus shown in FIG. 1.

FIG. 2 is an illustrative diagram which shows a schematic drawing of a paper conveyance path in the inkjet recording apparatus 100 shown in FIG. 1. As shown in FIG. 2, a recording medium S paid out from a pay-out supply roll 41*a* is conveyed intermittently in the recording medium conveyance direction X indicated by the arrow, by means of a pair of scanning conveyance rollers 43 arranged at the inlet of the print unit (the upstream side of the platen 27 in terms of the recording medium conveyance direction X). When the recording medium S has arrived at the print unit directly below the inkjet head 25, printing is carried out by the inkjet head 25 and the recording medium S is then wound up onto a take-up roll 41*b* after printing. A guide 45 for the recording medium S is provided on the downstream side of the print unit in the recording medium conveyance direction X.

A temperature adjustment unit 47 for adjusting the temperature of the recording medium S during printing is provided on the rear surface side (an opposite surface to the surface supporting the recording medium S) of the platen 27 which supports the recording medium S in the print unit, at a position opposing the inkjet head 25. When the recording medium S is adjusted to a prescribed temperature during printing, the viscosity, surface tension, and other physical properties, of the ink droplets deposited onto the recording medium S, assume prescribed values and it is possible to obtain a desired dot diameter. According to requirements, it is possible to provide a heat pre-adjustment unit 49 on the upstream side of the temperature adjustment unit 47 or to provide a heat after-adjustment unit 51 on the downstream side of the temperature adjustment unit 47.

Inkjet Head

Figure 3:
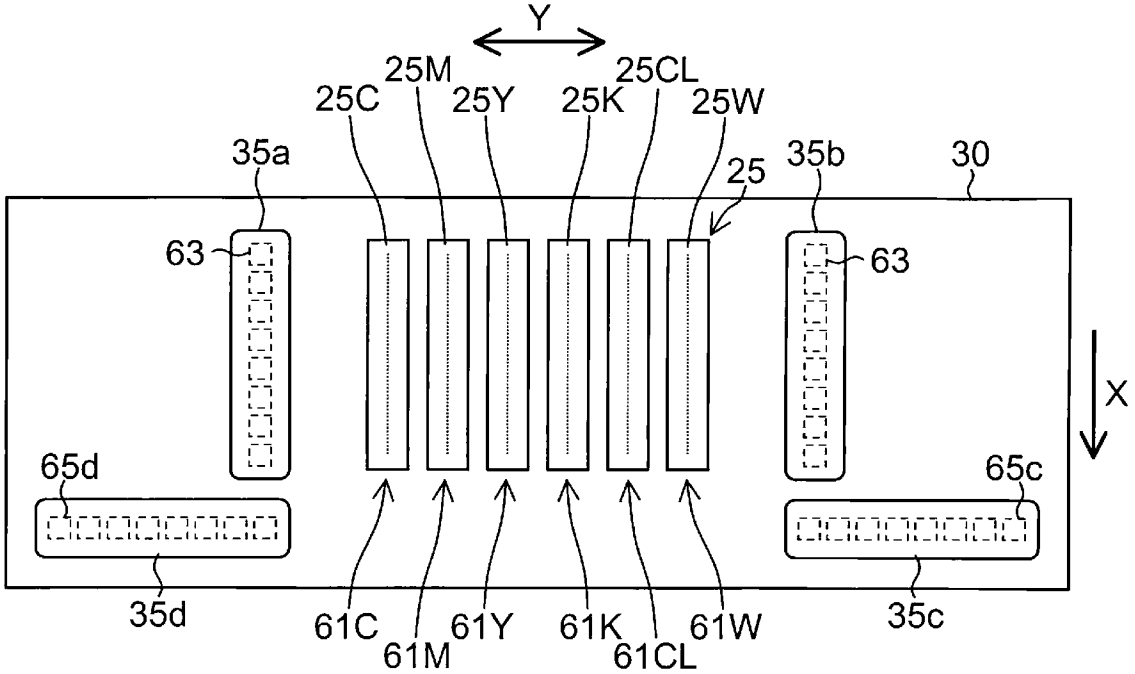
FIG. 3 is a plan view perspective diagram showing an example of the inkjet head shown in FIG. 1.

FIG. 3 is a plan view perspective diagram showing an example of the composition of an inkjet head 25.

The carriage 30 which moves reciprocally in the main scanning direction Y is mounted in an integrated fashion with the inkjet head 25 and the ultraviolet irradiation units 35*a*, 35*b*, 35*c*, 35*d*. Nozzle rows 61C, 61M, 61Y, 61K, 61CL, 61W each having a plurality of nozzles which are arranged equidistantly in a recording medium conveyance direction X, are provided in the inkjet head 25 so as to correspond to the respective colors of C, M, Y, K, CL, W.

In FIG. 3, the nozzle rows are indicated by dotted lines, and individual nozzles are not depicted. Furthermore, in the following description, the nozzle rows 61C, 61M, 61Y, 61K, 61CL, 61W are referred to generally by the reference numeral 61.

In the inkjet heads 25 according to the present embodiment, the nozzles constituting a nozzle row 61 have a nozzle arrangement pitch (nozzle pitch) of 254 μm (100 dpi), the number of nozzles constituting a nozzle row 61 is 256 nozzles, and the total length of the nozzle row is approximately 65 mm (254 μm×255=64.8 mm) Furthermore, the ejection frequency is 15 kHz, and ejection droplet volumes of three types, 10 pl, 20 pl, 30 pl, can be ejected selectively, by changing the drive waveform.

It is possible to adopt a mode which constitutes a separate inkjet head for each color. For example, it is also possible to adopt a mode where an inkjet head 25C having a nozzle row 61C, an inkjet head 25M having a nozzle row 61M, an inkjet head 25Y having a nozzle row 61Y, an inkjet head 25K having a nozzle row 61K, an inkjet head 25CL having a nozzle row 61CL, and an inkjet head 25W having a nozzle row 61W, are arranged equidistantly so as to be aligned in the main scanning direction.

Furthermore, it is also possible to add nozzle rows (inkjet heads) corresponding to LC (light cyan) and LM (light magenta), to the composition shown in FIG. 3, and it is also possible to use nozzle rows corresponding to LC and LM instead of the nozzle row (inkjet head) corresponding to CL and the nozzle row (inkjet head) corresponding to W.

The ink ejection method of the inkjet head 25 may be either a method which propels ink droplets by deformation of an actuator, typically, a piezo element (piezoelectric element) (a piezo jet method), or a thermal jet method which creates bubbles by heating ink by a heating element, such as a heater, and propels ink droplets by the pressure of the bubbles. However, if using UV ink, then it is desirable to employ a piezo jet method. In the present embodiment, a piezo jet method is used.

The inkjet head 25 having this structure employs a multi-pass type of image formation control, and the print resolution can be varied by changing the number of passes. In high-productivity mode, printing is carried out at a resolution of 600 dpi×400 dpi. A resolution of 600 dpi in the main scanning direction can be achieved by means of 2 passes (two scans), dots being formed at a resolution of 300 dpi in the first scan (forward movement), and dots being formed, so as to be interposed at 300 dpi between the dots formed by the first scan, in a second scan (return movement). Furthermore, since dots are formed at a resolution of 100 dpi in the sub-scanning direction by one scan, then a resolution of 400 dpi can be achieved by four passes (four scans).

In standard mode, printing is carried out at a resolution of 600 dpi×800 dpi, and this 600 dpi×800 dpi resolution can be achieved by means of two passes in the main scanning direction and eight passes in the sub-scanning direction. In high-quality mode, printing is carried out at a resolution of 1200 dpi×1200 dpi, and this 1200 dpi×1200 dpi resolution can be achieved by means of four passes in the main scanning direction and twelve passes in the sub-scanning direction. The main scanning speed of the carriage is 1270 mm/sec in high-productivity mode.

Ultraviolet Irradiation Unit

The ultraviolet irradiation units 35*a*, 35*b* shown in FIG. 3 include a plurality of ultraviolet LED elements (simply called "LED elements" below) 63 as a light source (pinning light source) for provisionally curing the ink droplets ejected from the inkjet head 25 which have landed on the recording medium S, in such a manner that mutually adjacent droplets do not combine with each other. Moreover, the ultraviolet irradiation units 35*c*, 35*d* include a plurality of LED elements 65*c*, 65*d* as a light source (curing light source) for finally curing the ink droplets completely (main curing).

More specifically, ultraviolet irradiation units 35*a*, 35*b* which are active energy irradiation devices are provided on both the left and right-hand sides of the inkjet heads 25 in the main scanning direction Y, and ultraviolet irradiation units 35*c* and 35*d* are also provided on the downstream side of the inkjet heads 25 in terms of the recording medium conveyance direction X. The ultraviolet irradiation units 35*a*, 35*b* are movable in unison with the inkjet heads 25, by reciprocal moment of the carriage 30. When using ultraviolet-curable ink (UV ink), the ink droplets which have been ejected from the nozzles and deposited on the recording medium S receive irradiation of ultraviolet light for provisional curing by at least one of the ultraviolet irradiation units 35*a* and 35*b* which pass over the ink immediately after it has been deposited on the medium.

Moreover, the ink droplets on the recording medium S which have passed the printing region of the inkjet head 25 then receive irradiation of ultraviolet light for main curing by the ultraviolet irradiation units 35*c* and 35*d*. The color ink on the recording medium S which has passed the image formation region of the inkjet head 25 receives irradiation of ultraviolet light for main curing from the ultraviolet irradiation units 35*c* and 35*d*, when the ultraviolet irradiation units 35*c*, 35*d* pass thereover due to the reciprocal movement of the carriage 30.

The ultraviolet irradiation units 35*a*, 35*b* have a structure in which a plurality of LED elements 63 are arranged in one row in the sub-scanning direction X. FIG. 3 shows an example of a mode where eight LED elements 63 are provided in the ultraviolet irradiation units 35*a*, 35*b*, but the number of elements can be reduced appropriately, for instance, the number of LED elements 63 can be set to 4, 2 or 1, in accordance with the irradiation energy required for provisional curing. Of course, it is also possible to adopt a mode which includes more than eight LED elements 63.

The ultraviolet irradiation units 35*c*, 35*d* have a structure in which a plurality of LED elements 65*c*, 65*d* are arranged along the main scanning direction. Furthermore, the LED elements 65*c* of the ultraviolet irradiation unit 35*c* are arranged in the opposite direction to the nozzle row 61W, and the LED elements 65*d* of the ultraviolet irradiation unit 35*d* are arranged in the opposite direction to the nozzle row 61C. By means of this structure, the ultraviolet light irradiated from the ultraviolet irradiation units 35*c*, 35*d* is prevented from reaching the nozzle rows 61C, 61M, 61Y, 61K, 61CL, 61W and curing the ink inside the nozzles.

Ink Supply System

Figure 4:
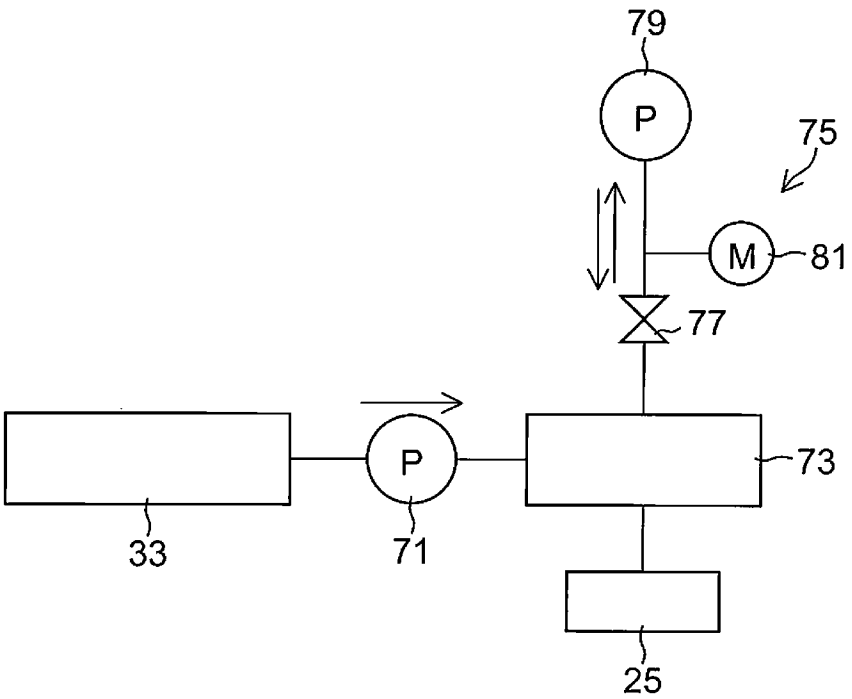
FIG. 4 is a block diagram showing a configuration of an ink supply system of the inkjet recording apparatus shown in FIG. 1.

FIG. 4 is a block diagram showing a configuration of an ink supply system of the inkjet recording apparatus 100 shown in FIG. 1. As shown in FIG. 4, ink accommodated in a cartridge 33 is suctioned by the supply pump 71, and is conveyed to the inkjet head 25 via a sub-tank 73. A pressure adjustment unit 75 for adjusting the pressure of the ink therein is provided with the sub-tank 73.

The pressure adjustment unit 75 includes a pressure reducing pump 79 which is connected to the sub tank 73 by means of a valve 77, and a pressure gauge 81 which is provided between the valve 77 and the pressure reducing pump 79.

During normal printing, the pressure reducing pump 79 operates in a direction such that ink inside the sub-tank 73 is suctioned, and keeps a negative pressure inside the sub-tank 73 and a negative pressure inside the inkjet head 25. On the other hand, during maintenance of the inkjet head 25, the pressure reducing pump 79 is operated in a direction such that the pressure of the ink inside the sub tank 73 is increased, thereby forcibly raising the internal pressure of the sub-tank 73 and the internal pressure of the inkjet head 25, and ink inside the inkjet head 25 is expelled via nozzles. The ink which has been forcibly expelled from the inkjet head 25 is accommodated in the ink receptacle of the cap described above.

Description of Block Diagram of Inkjet Recording Apparatus

Figure 5:
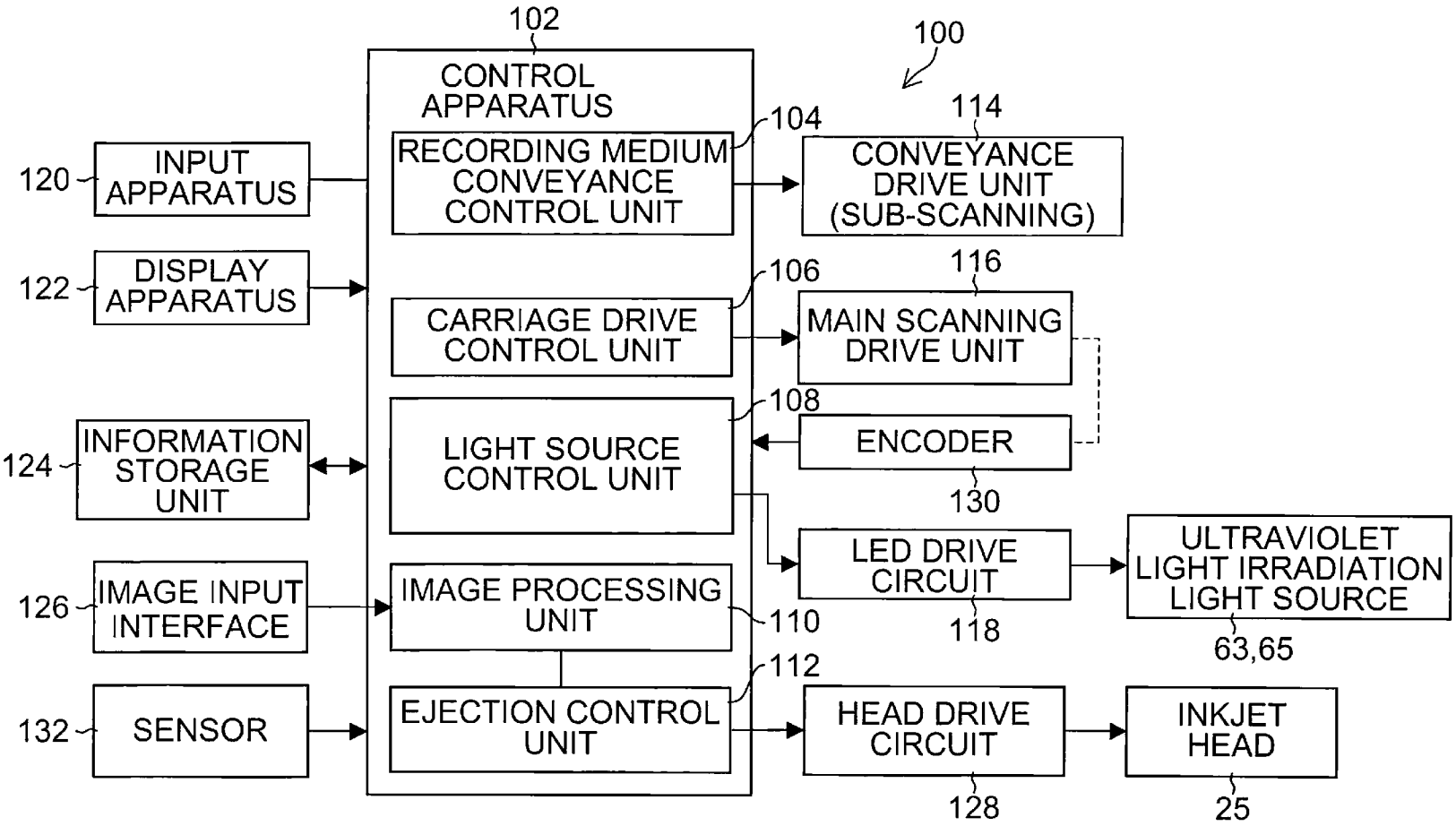
FIG. 5 is a block diagram showing the configuration of the inkjet recording apparatus shown in FIG. 1.

FIG. 5 is a block diagram of the composition of an inkjet recording apparatus 100 relating to an embodiment of the present invention. As shown in FIG. 5, in the inkjet recording apparatus 100, a control apparatus 102 is provided as a control device. For this control apparatus 102, it is possible to use, for example, a computer equipped with a central processing unit (CPU), or the like. The control apparatus 102 functions as a control apparatus for controlling the whole of the inkjet recording apparatus 100 in accordance with a prescribed program, as well as functioning as a calculation apparatus for performing respective calculations. The control apparatus 102 includes a recording medium conveyance control unit 104, a carriage drive control unit 106, a light source control unit 108, an image processing unit 110, and an ejection control unit 112. These respective units are achieved by a hardware circuit or software, or a combination of these.

The recording medium conveyance control unit 104 controls the conveyance drive unit 114 for conveying the recording medium S (see FIG. 1). The conveyance drive unit 114 includes a drive motor which drives the scanning conveyance roller pair 43 shown in FIG. 2, and a drive circuit thereof. The recording medium S which is conveyed onto the platen 27 (see FIG. 1) is conveyed intermittently in swath width units in the sub-scanning direction, in accordance with a reciprocal scanning action (printing pass action) in the main scanning direction Y performed by the inkjet head 25.

The carriage drive control unit 106 shown in FIG. 5 controls the main scanning drive unit 116 for moving the carriage 30 (see FIG. 1) in the main scanning direction Y. The main scanning drive unit 116 includes a drive motor which is connected to a movement mechanism of a carriage 30, and a control circuit thereof. The light source control unit 108 is a control device which controls light emission by the ultraviolet irradiation light sources (LED elements) 63, 65 via an LED drive circuit 118.

An input apparatus 120, such as an operating panel, and a display apparatus 122, are connected to the control apparatus 102. The input apparatus 120 is a device by which manually performed external operating signals are input to the control apparatus 102, and may employ various formats, such as a keyboard, a mouse, a touch panel, or operating buttons, or the like. The display apparatus 122 may employ various formats, such as a liquid crystal display, an organic EL display, a CRT, or the like. An operator is able to input print conditions, and input and edit additional conditions, and the like, by operating the input apparatus 120, and is able to confirm the input details and various information such as search results, via the display on the display apparatus 122.

Furthermore, an information storage unit 124 which stores various information and an image input interface 126 for acquiring image data for printing are provided in the inkjet recording apparatus 100. It is possible to employ a serial interface or a parallel interface for the image input interface. It is also possible to install a buffer memory (not illustrated) for achieving high-speed communications.

The image data input via the image input interface 126 is converted into data for printing (dot data) by the image processing unit 110. In general, the dot data is generated by subjecting the multiple-tone image data to color conversion processing and half-tone processing. The color conversion processing is processing for converting image data represented by an sRGB system (for example, 8-bit RGB image data of respective colors of RGB) or another system, into image data of the respective colors of ink used in the inkjet recording apparatus 100.

A half-toning process is processing for converting the color data of the respective colors generated by the color conversion processing into dot data of respective colors by error diffusion, a threshold value matrix, or the like. The device carrying out the half-toning process may employ commonly known methods of various kinds, such as an error diffusion method, a dithering method, a threshold value matrix method, a density pattern method, or the like. The half-toning process generally converts tonal image data having M values ($M \geq 3$) into tonal image data having N values ($N<M$). In the simplest example, the image data is converted into dot image data having 2 values (dot on/dot off), but in a half-toning process, it is also possible to perform quantization in multiple values which correspond to different types of dot size (for example, three types of dot: a large dot, a medium dot and a small dot).

The binary or multiple-value image data (dot data) obtained in this way is used for driving (on) or not driving (off) the respective nozzles, or in the case of multiple-value data, is used as ink ejection data (ejection control data) for controlling the droplet volume (dot size).

The ejection control unit 112 generates an ejection control signal for the head drive circuit 128 on the basis of dot data generated in the image processing unit 110. Furthermore, the ejection control unit 112 includes a drive waveform generation unit, which is not illustrated. The drive waveform generation unit is a device which generates a drive voltage signal for driving the ejection energy generation elements (in the present embodiment, piezo elements) which correspond to the respective nozzles of the inkjet head 25. The waveform data of the drive voltage signal is stored previously in the information storage unit 124 and waveform data to be used is output as and when required. The signal (drive waveform) output from the drive waveform generation unit is supplied to the head drive circuit 128. The signal output from the drive waveform generation unit may be digital waveform data or an analog voltage signal.

Ink is ejected from the corresponding nozzles by applying a common drive voltage signal to the ejection energy generation devices of the inkjet head 25 via the head drive circuit 128 and switching the switching elements (not illustrated) which are connected to the individual electrodes of the energy generating elements on and off in accordance with the ejection timings of the respective nozzles.

Programs to be executed by the CPU of the system controller 102 and various data required for control purposes are stored in the information storage unit 124. The information storage unit 124 stores resolution settings information based on the print mode, the number of passes (number of scanning repetitions), and control information for the ultraviolet irradiation light sources 63, 65, and the like.

An encoder 130 is installed on the rotational shaft of the drive motor of the main scanning drive unit 116 and the rotational shaft of the drive motor of the conveyance drive unit 114, and a pulse signal is output in accordance with the amount of rotation and the speed of rotation of the drive motors. The pulse signals output from the encoders 130 are supplied to the control apparatus 102, where the position of the carriage 30, the position and attitude of the recording medium S (see FIG. 1) and the image formation area on the recording medium S, and the like, are identified on the basis of the pulse signals output from the encoders 130.

A sensor 132 is installed on the carriage 30 (see FIG. 6), and the sensor signal output from the sensor 132 is supplied to the control apparatus 102. The width of the recording medium S (the end positions in the main scanning direction) is identified on the basis of the sensor signal output from the sensor 132. An optical sensor provided with a light emitting unit and a light receiving unit is one example of the composition of the sensor 132.

Description of Irradiation of Ultraviolet Light (Active Light Beam)

Next, the control of ultraviolet light irradiation which is employed in the inkjet recording apparatus 100 relating to an embodiment of the present invention will be described in detail. The ultraviolet light irradiation control according to the present embodiment involves controlling the irradiation start timing and the irradiation stop timing of the ultraviolet irradiation units 35*a*, 35*b*, 35*c*, 35*d*, in accordance with the effective nozzle area in the inkjet head 25, the scanning speed of the carriage 30, the arrangement of the ultraviolet irradiation units 35*a*, 35*b*, 35*c*, 35*d* in the carriage 30, and the shape of the image formation area (the area where ink droplets are deposited).

Prescribing Image Formation Area

Figure 6:
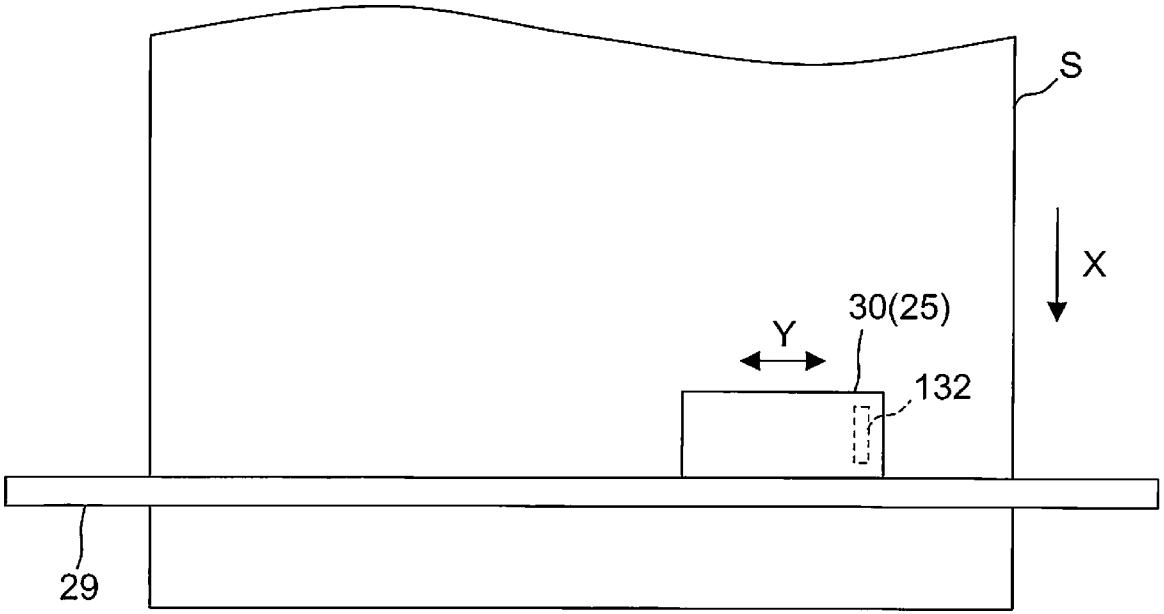
FIG. 6 is an illustrative diagram showing a schematic view of detection of an image formation area.

FIG. 6 is an illustrative diagram showing a schematic view of one example of the detection of an image formation area using a sensor 132. In the inkjet recording apparatus 100 shown in the present embodiment, the image formation area is prescribed by acquiring information about the image formation area on the recording medium S before printing. The "image formation area" may be an area where the ink is actually deposited in printing, or it may be an area where ink can be deposited (printable area).

Possible methods for prescribing the image formation area are a method which prescribes an image formation area on the basis of detection signals from the sensor 132 and encoder values obtained from the encoder 130 (see FIG. 5), and a method which prescribes an image formation area on a host (control apparatus 102 in FIG. 5), on the basis of image data.

In the prescription of the image formation area which uses a sensor 132 and an encoder 130, the carriage 30 is scanned (moved) in the main scanning direction Y, the width (each of the end positions) of the recording medium S in the main scanning direction Y is detected, and the encoder values corresponding to the respective end positions of the recording medium S are stored. The image formation area is the area between the encoder values corresponding to the respective end sections. For example, the image formation area is and interior of the recording medium S (a rectangular region), as indicated by the dotted lines in FIG. 6. If a protrusion section 200 of a rigid medium such as that shown in FIG. 15 forms an image formation area, then the encoder values corresponding to the edges of the protrusion section are stored.

On the other hand, if a blank margin area is provided at the edges of the recording medium S, the image formation area covers the whole width of the recording medium S apart from (except for) the blank margin portions on either side. If the shape of the recording medium S is not rectangular, then it is possible to identify a two-dimensional image formation area by detecting the width of the recording medium S at a plurality of positions in the sub-scanning direction X while moving the recording medium S in the sub-scanning direction X. The image formation area can be prescribed on a host (control apparatus 102), on the basis of information about the recording medium S (shape, size, etc.) and image data. In the description below, an example is given in which the image formation area is prescribed in the sub-scanning direction (nozzle row direction).

Ink Ejection and Ink Curing Processes

When the image formation area has been prescribed, then when the nozzle rows 61-1 to 61-4 of the inkjet head 25 arrive at the end of the image formation area while scanning the inkjet head 25 in the main scanning direction Y and moving the recording medium S in the sub-scanning direction X, ink ejection is started in accordance with the image data (dot data) from this timing. When ink is ejected from the respective nozzle rows 61-1 to 61-4, ultraviolet light is irradiated onto the ink droplets immediately after landing on the recording medium S, by using either one of the ultraviolet irradiation units 35*a*, 35*b* which function as provisional curing light sources, thereby provisionally curing the ink droplets.

Furthermore, when the provisionally cured ink has left the print region of the inkjet head 25 (the region where the nozzle rows 61 are provided), then ultraviolet light is irradiated from the ultraviolet irradiation units 35*c* and 35*d* which function as main curing light sources, thereby fully curing the ink droplets.

Positioning of Provisional Curing in Main Scanning Direction

Figure 7:
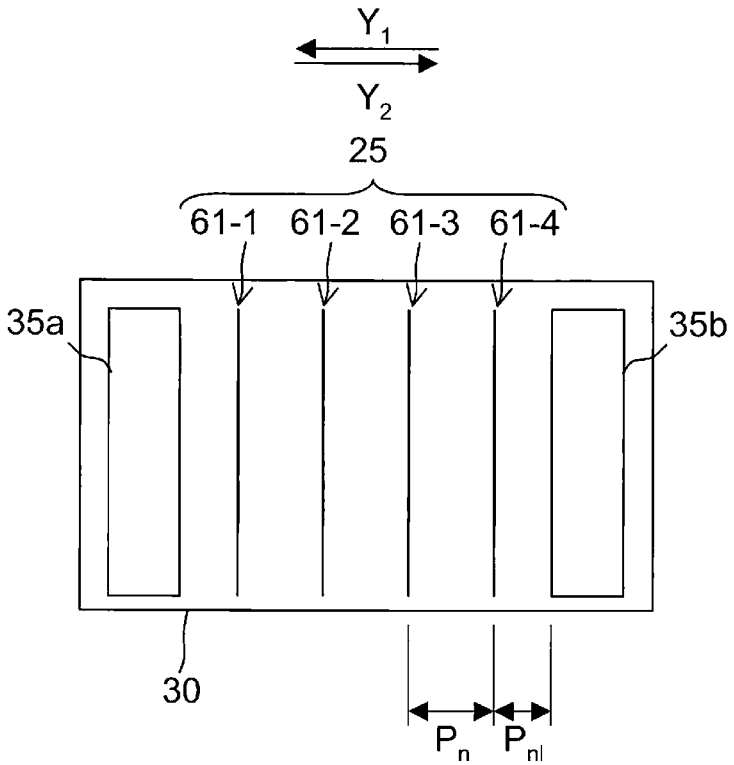
FIG. 7 is an illustrative diagram showing the positional relationship of nozzle rows and ultraviolet light irradiation units for provisional curing.

Next, the positioning in the main scanning direction of ink ejection and ultraviolet light irradiation for provisional curing will be described. FIG. 7 is an illustrative diagram showing the positional relationship between the nozzle rows 61 and the ultraviolet irradiation units 35*a*, 35*b*. In the description given below, a case is explained in which an inkjet head 25 including four nozzle rows 61-1 to 61-4 and ultraviolet irradiation units 35*a*, 35*b* which are disposed on either side of the four nozzle rows in the main scanning direction are mounted on a carriage 30. The reference numeral $P_n$ represents the arrangement pitch of the nozzle rows 61-1 to 61-4 and the reference numeral $P_{n1}$ represents the arrangement pitch between the nozzle row 61-4 and the ultraviolet irradiation unit 35*b*.

Firstly, a case is considered in which the carriage 30 is moved one way in the main scanning direction (the direction from right to left in FIG. 7 indicated by reference numeral $Y_1$). The nozzle rows 61-1 to 61-4 sequentially arrive at the image formation area and ink is ejected sequentially from the nozzle rows 61-1 to 61-4. When the ultraviolet irradiation unit 35*b* (the irradiation area of the ultraviolet irradiation unit 35*b*) which is disposed on the upstream side of the nozzle row 61-4 in terms of the scanning direction of the carriage 30 arrives at one end of the image formation area (the starting end), irradiation of ultraviolet light is started at this timing. In this case, ultraviolet light is not radiated from the ultraviolet irradiation unit 35*a*.

In this way, when the carriage 30 is scanned one way $Y_1$ in the main scanning direction and the ultraviolet irradiation unit 35*b* (the irradiation area of the ultraviolet irradiation unit 35*b*) arrives at the other end (the finish end) of the image formation area (when the end of the irradiation area of the ultraviolet irradiation unit 35*b* leaves the image formation area), then the irradiation of ultraviolet light by the ultraviolet irradiation unit 35*b* is halted. If the carriage 30 is scanned one way $Y_1$ in the main scanning direction and ink is ejected from the nozzle rows 61-1 to 61-4, then the ultraviolet irradiation unit 35*a* which precedes the nozzle rows 61-1 to 61-4 is kept off and does not irradiate ultraviolet light. Of course, if the cumulative amount of ultraviolet light is increased and curing is to be promoted, then the ultraviolet light may also be irradiated from the ultraviolet irradiation unit 35*a* within the image formation area.

(a) to (e) of FIG. 8 are diagrams showing the relationship between the ejection timing of an inkjet head and the ultraviolet light irradiation timing of ultraviolet irradiation units 35*a* and 35*b*, in the main scanning direction. (a) to (d) of FIG. 8 show the ejection timings of nozzle rows 61-1 to 61-4, and (e) of FIG. 8 shows the exposure time of the ultraviolet irradiation unit 35*b* (the ultraviolet irradiation start timing and end timing). As shown in the drawing, the respective ejection start timings of the nozzle rows 61-1 to 61-4 are delayed respectively from the adjacent nozzle row by a time $\Delta t_1$ which is determined by dividing the arrangement pitch $P_n$, of the nozzle rows 61-1 to 61-4 by the scanning speed of the carriage 30 (see FIG. 7).

Furthermore, the exposure start timing of the ultraviolet irradiation unit 35*b* is delayed from the ejection start timing of the adjacent nozzle row 61-4 by a time $\Delta t$ which is determined by dividing the arrangement pitch $P_{n1}$ between the nozzle row 61-4 and the ultraviolet irradiation unit 35*b*, by the scanning speed of the carriage 30. Furthermore, the exposure end timing of the ultraviolet irradiation unit 35*b* is delayed by a time $\Delta t_2$ with respect to the ejection end timing of the nozzle row 61-4 which is adjacent to the ultraviolet irradiation unit 35*b*.

When the carriage 30 is moved in the $Y_2$ direction which is opposite to the $Y_1$ direction, the ultraviolet irradiation unit 35*a* is used instead of the ultraviolet irradiation unit 35*b* and exposure by the ultraviolet irradiation unit 35*a* is started at a delay of $\Delta t_1$ from the ejection start timing of the nozzle row 61-1 which is adjacent to the ultraviolet irradiation unit 35*a*, and exposure by the ultraviolet irradiation unit 35*a* is ended at a delay of $\Delta t_2$ from the ejection end timing of the nozzle row 61-1.

Positioning of Provisional Curing in Sub-scanning Direction

Next, the positioning in the main scanning direction X of ink ejection and ultraviolet light irradiation for provisional curing will be described. In the following description, the ultraviolet irradiation units 35*a* and 35*b* have a greater length than the nozzle rows. In the following description, parts which are the same as or similar to the preceding description are labelled with the same reference numerals.

FIG. 9 is an illustrative diagram showing the positional relationship between the nozzle rows 61-1 to 61-4 and the ultraviolet irradiation units 35*a*, 35*b*. As shown in FIG. 9, the length $L_h$ in the sub-scanning direction of the nozzle rows 61-1 to 61-4 and the length $L_l$ in the sub-scanning direction of the ultraviolet irradiation units 35*a*, 35*b* are in a relationship $L_h<L_l$. Considering the sequence of n writing actions (n number of passes) in the sub-scanning direction, and taking the time required for the recording medium S (see FIG. 6) to pass through the image formation area as a reference, the time until the recording medium S passes the ultraviolet irradiation units 35*a*, 35*b* takes up $L_l/L_h$ sequences.

For example, four writing sequences are employed in the sub-scanning direction, and when $L_l/L_h=1.5$, then the irradiation of ultraviolet irradiation units 35*a*, 35*b* is required to be enabled for time for two sequences corresponding to $4\times1.5-4$ ((number of passes)$\times(L_l/L_h)$−(number of passes)) after the end of image formation.

(a) to (f) of FIG. 10 are diagrams showing the relationship between the ejection timing of the nozzle rows 61-1 to 61-4 and the ultraviolet light irradiation timing of the ultraviolet irradiation units 35*a* and 35*b*, in the sub-scanning direction. (a) to (d) of FIG. 10 show the ejection timings of the nozzle rows 61-1 to 61-4, (e) of FIG. 10 shows the exposure (ultraviolet light irradiation) timing of the ultraviolet irradiation unit 35*b*, and (f) of FIG. 10 shows the exposure timing of the ultraviolet irradiation unit 35*a*. One writing action (one pass) is performed in the main scanning direction and four writing actions (four passes) are performed in the sub-scanning direction.

As shown in the drawing, in a first scan in the main scanning direction (the $Y_1$ direction in FIG. 9), ink is ejected sequentially from the nozzle rows 61-1 to 61-4 and exposure is performed by the ultraviolet irradiation unit 35*b*. When the ultraviolet irradiation unit 35*b* reaches the other end of the image formation area and exposure is ended, the recording medium S is moved through ($L_h$/number of passes) in the sub-scanning direction, and a second main scanning action is performed. In the second main scan (a scan in the $Y_2$ direction in FIG. 9), ink is ejected sequentially from the nozzle rows 61-4 to 61-1 and exposure is performed by the ultraviolet irradiation unit 35*a*. When the ultraviolet irradiation unit 35*a* reaches the one end of the image formation area and exposure is ended, the recording medium S is moved through ($L_h$/number of passes) in the sub-scanning direction, and a third main scanning action is performed.

In this way, when a third main scanning action (a repeat of the first main scanning action) and a fourth main scanning action (a repeat of the second main scanning action) are carried out, the recording medium S is moved further through ($L_h$/number of passes) and a fifth main scanning action (a scan in the $Y_1$ direction in FIG. 9) is performed. In the fifth main scanning action, exposure is performed by the ultraviolet irradiation unit 35*b*. When the fifth main scanning action has ended, the recording medium S is moved further through ($L_h$/number of passes) and a sixth main scanning action (scanning in the $Y_2$ direction in FIG. 9) is carried out. When the sixth main scanning action has ended, the recording medium S is moved through ($L_h$/number of passes) in the sub-scanning direction and a similar sequence is repeated.

Positioning of Main Curing Light Sources in Main Scanning Direction

Next, the positioning of the ultraviolet irradiation units 35*c* and 35*d* (see FIG. 3) in the main scanning direction Y will be described. (a) to (f) of FIG. 11 are diagrams showing the relationship between the ink ejection timings of the nozzle rows 61-1 to 61-4 and the irradiation timing of the ultraviolet irradiation units 35*b* and 35*c*. (a) to (d) of FIG. 11 show the ink ejection timings of the nozzle rows 61-1 to 61-4, (e) of FIG. 11 shows the irradiation timing of the ultraviolet irradiation unit 35*b*, and (f) of FIG. 11 shows the irradiation timing of the ultraviolet irradiation unit 35*c*.

The ultraviolet irradiation unit 35*c* is longer in the main scanning direction than the ultraviolet irradiation unit 35*b*, and therefore the on time is longer with respect to the ejection timing of the nozzle row 61-4 and if the LED elements 65*c* provided in the ultraviolet irradiation 35*c* are switched on or off simultaneously, then the irradiation time becomes longer in accordance with the amount by which the ultraviolet irradiation unit 35*c* is longer than the ultraviolet irradiation unit 35*b* in the main scanning direction, and this is problematic since the ultraviolet light is also irradiated outside of the intended area. Therefore, the ultraviolet irradiation units 35*c* and 35*d* are divided into a plurality of areas in the main scanning direction Y, and the on/off switching of the LED elements 65*c* and 65*d* is controlled with respect to each of the areas.

FIG. 12 is an illustrative diagram of a case where the ultraviolet irradiation unit 35*c* is divided into four areas (division units) 35*c*-1 to 35*c*-4, and the ultraviolet irradiation unit 35*d* is divided into four areas 35*d*-1 to 35*d*-4. The arrangement pitch of the areas 35*c*-1 to 35*c*-4 and 35*d*-1 to 35*d*-4 in the main scanning direction is $P_{IY}$. As shown in FIG. 3, the ultraviolet irradiation units 35*c*, 35*d* each include eight LED elements 65*c*, 65*d*, and therefore the divided areas 35*c*-1 to 35*c*-4 and 35*d*-1 to 35*d*-4 each include two LED elements 65*c*, 65*d*.

(a) to (h) of FIG. 13 are illustrative diagrams showing the relationship between the ejection timings of the nozzle rows 61-1 to 61-4 and the irradiation timings in the respective areas 35*c*-1 to 35*c*-4 of the ultraviolet irradiation unit 35*c*. The relationship between the ejection timings of the nozzle rows 61-1 to 61-4 and the irradiation timings in the respective areas 35*c*-1 to 35*c*-4 of the ultraviolet irradiation unit 35*c* is depicted for a case where the carriage 30 is moved in the $Y_1$ direction (see FIG. 12).

The irradiation start timing in the area 35*c*-1 which is nearest to the nozzle row 61-4 (the same as the irradiation start timing of the ultraviolet irradiation unit 35*b*) is delayed with respect to the ejection timing of the nozzle row 61-4 by a time of $\Delta t_2$ which is determined by dividing the arrangement pitch $P_{1n}$ between the nozzle row 61-4 and the area 35*c*-1 (the ultraviolet irradiation unit 35*c*), by the scanning speed of the carriage 30.

Furthermore, the irradiation start timing of the area 35*c*-2 which is adjacent to the right-hand side of the area 35*c*-1 in the diagram (the upstream side in terms of the scanning direction of the carriage 30) is delayed from the irradiation timing of the area 35*c*-1 by a time of $\Delta t_3$ which is determined by dividing the arrangement pitch $P_{IY}$ of the respective areas in the main scanning direction by the scanning speed of the carriage 30. The irradiation start timings of the areas 35*c*-3 and 35*c*-4 are also delayed by a time of $\Delta t_3$ with respect to the adjacent area on the downstream side in terms of the scanning direction of the carriage 30.

On the other hand, the irradiation end timings of the areas 35*c*-1 to 35*c*-4 are also delayed by a time of $\Delta t_3$ with respect to the adjacent area on the downstream side in terms of the scanning direction of the carriage 30. For the ultraviolet irradiation unit 35*d*, the irradiation start timing and the irradiation end timing are controlled with respect to each of the areas 35*d*-1 to 35*d*-4, by means of the same sequence.

In other words, regardless of the position of the nozzle rows 61-1 to 61-4, the irradiation start timing and the irradiation end timing are controlled in accordance with the passage of the image formation area, sequentially from the downstream side of the scanning direction of the carriage 30, through the areas 35*c*-1 to 35*c*-4 which are arranged in the main scanning direction, and therefore ultraviolet light is not irradiated onto regions other than the image formation area and unexpected irradiation of ultraviolet light is prevented.

In the example shown in (a) to (h) of FIG. 13, a mode is depicted in which the ultraviolet irradiation units 35*c*, 35*d* are divided into four areas, but if the irradiation start timing and the irradiation end timing are controlled for each LED element 65*c*, 65*d*, then the on/off switching of the ultraviolet irradiation units 35*c*, 35*d* can be controlled more accurately in accordance with the passage of the image formation area.

As shown in FIG. 14, by controlling the irradiation start timing and the irradiation end timing for each of the four divided areas 35*a*-1 to 35*a*-4 and 35*b*-1 to 35*b*-4, in the ultraviolet irradiation units 35*a*, 35*b* which include a plurality of LED elements 63, or for each of the LED elements 63, then even if the recording medium S, the image formation area and the image to be formed have various shapes, the irradiation of ultraviolet light by the ultraviolet irradiation units 35*a* and 35*b* can be controlled finely in accordance with the shape of the region where ink is deposited on the recording medium S, and unexpected irradiation of ultraviolet light can be prevented.

For example, if the length of the image formation area in the main scanning direction is not uniform, the width of the image formation area is prescribed for each scanning action in one way of the main scanning direction, ink is ejected sequentially from the nozzles which have arrived at the image formation area in order of arrival, and ink ejection is ended sequentially as the nozzles leave the image formation area in order of leaving. Furthermore, for each of the LED elements 63, irradiation of ultraviolet light is started at the timing that the LED element arrives at the image formation area, and irradiation of ultraviolet light is halted at the timing that the LED element leaves the image formation area.

If the irradiation area of one LED element 63 corresponds to the ejection positions of a plurality of nozzles and the ejection timings of the plurality of nozzles are different, then the irradiation of ultraviolet light is started in accordance with the earliest ejection start timing of the ejection timings of the plurality of nozzles, and irradiation of ultraviolet light is ended in accordance with the latest ejection end timing of the plurality of nozzles.

In the present embodiment, an example is given in which the ultraviolet light is used as an active light beam for curing ink, but it is also possible to use a light beam having a wavelength band other than ultraviolet light as the active light beam. More specifically, the active light beam which cures ink can employ a light beam of a wavelength band which is capable of irradiating the energy required to cure ink. Furthermore, it is also possible to use active light beams having different wavelength bands in the main curing light sources and the provisional curing light sources. For example, the provisional curing light sources can employ light sources which irradiate an amount of energy for curing the ink to the extent of suppressing movement of the ink and which generate lower active energy than the main curing light source. On the other hand, the main curing light source employs a light beam capable of generating an active energy which is higher than the provisional curing light source.

Inkjet recording apparatuses and the image forming methods to which embodiments of the present invention are applied have been described in detail above, but suitable modifications are possible in a range which does not depart from the essence of the present invention.

Appendix

As has become evident from the detailed description of the embodiments given above, the present specification includes disclosure of various technical ideas including aspects of the invention described below.

One aspect of the invention is directed to an inkjet recording apparatus comprising: an inkjet head having nozzles which eject ink onto a recording medium, the ink being curable by irradiation of an active light beam; a relative movement device which causes relative movement between the inkjet head and the recording medium; an active light beam irradiation device having an active light beam emission unit that emits the active light beam and is divided into units in a direction of the relative movement for irradiating the ink deposited on the recording medium with the active light beam while relative movement between the recording medium and the active light beam irradiation device is caused along with the inkjet head; and an active light beam irradiation control device which controls on or off switching with respect to each of the divided units of the active light beam emission unit in terms of an alignment sequence of the divided units in the direction of the relative movement, and switches on the divided units of the active light beam emission unit sequentially in order of reaching an image formation area on the recording medium, and switches off the divided units of the active light beam emission unit sequentially in order of leaving the image formation area.

According to this aspect of the invention, the divided units of an active light beam emission unit having a structure divided in the relative movement direction of an inkjet head are controlled on or off in alignment sequence, the divided units being switched on in sequence of arriving at an image formation area and being switched off in sequence of leaving the image formation area, and therefore an active light beam is radiated only onto the image formation area and irradiation of an active light beam in unexpected directions or onto unexpected regions is suppressed.

Desirably, the active light beam emission unit includes ultraviolet LED elements at least one of which is assigned to each of the divided units.

According to this mode, it is possible to switch the active light beam emission unit on and off, with respect to each of the divided units. The delay time with respect to the on/off command is short and the control of on/off switching is simple.

Desirably, the inkjet recording apparatus comprises an image formation area prescribing device which prescribes the image formation area.

According to this mode, the ink ejection timing and the active light beam irradiation timing are both decided on the basis of the prescribed image formation area.

The image formation area prescribing device may include a detection device which detects both ends of the recording medium (the width of the recording medium) in the direction of movement of the inkjet head, and a storage device which stores information about both ends of the recording medium obtained from the detection results of the detection device. Furthermore, it is also possible to adopt a mode in which the image formation area is prescribed by a program (software) on the basis of image data.

Desirably, the inkjet recording apparatus comprises an ejection control device which controls ejection by the inkjet head in such a manner that ink ejection is started at a timing that the nozzles arrive at the image formation area, and the ink ejection is ended at a timing that the nozzles leave the image formation area, wherein: the relative movement device includes: a scanning device which moves the inkjet head and the active light beam irradiation device in a main scanning direction; and a recording medium conveyance device which conveys the recording medium in a sub-scanning direction that is perpendicular to the main scanning direction; and the active light beam irradiation control device controls irradiation of the active light beam in such a manner that the divided units of the active light beam emission unit are switched on sequentially from a side having a shorter arrangement interval with respect to the nozzles, and light emission of the divided units of the active light beam emission unit is started at a timing where a time period determined by dividing the arrangement interval between the nozzles and the divided units of the active light beam emission unit by a scanning speed of the scanning device has elapsed from an ink ejection start timing of the nozzles.

According to this mode, irradiation of the active light beam to the outside of the image formation area is prevented, because ink ejection is controlled in such a manner that ink ejection is started at the timing that the nozzles which eject ink arrive at the image formation area and ink ejection is ended at the timing that the nozzles leave the image formation area, the timing at which each divided unit of the active light beam emission unit arrives at the image formation area being judged on the basis of the time from the ejection start timing of the nozzles, and emission of the active light beam being started sequentially at the corresponding timing.

Desirably, the active light beam irradiation control device controls the irradiation of the active light beam in such a manner that the divided units of the active light beam emission unit are switched off sequentially from a side having a shorter arrangement interval with respect to the nozzles, and the light emission of the divided units of the active light beam emission unit is halted at a timing where a time period determined by dividing the arrangement interval between the nozzles and the divided units of the active light beam emission unit by the scanning speed of the scanning device has elapsed from an ink ejection end timing of the nozzles.

According to this mode, since the timing at which each divided unit of the active light emission unit leaves the image formation area is judged on the basis of the time from the ejection end timing of the nozzles and emission of the active light beam is halted sequentially at the corresponding timing, then irradiation of the active light beam outside the image formation area is prevented.

Desirably, the active light beam irradiation device has a structure in which the active light beam emission unit which emits the active light beam is divided into units in a scanning direction of the scanning device and includes a main curing device which is arranged to a downstream side of the inkjet head in terms of the direction of conveyance by the recording medium conveyance device and which cures the ink on the recording medium in such a manner that the ink is fixed to the recording medium.

According to this mode, unexpected irradiation of the active light beam irradiated by the main curing device which fixes the ink droplets onto the recording medium (which fully cures the ink droplets) can be avoided.

Desirably, in the inkjet recording apparatus as defined in any one of the above modes, the relative movement device includes a scanning device which moves the inkjet head and the active light beam irradiation device in a main scanning direction and a recording medium conveyance device which conveys the recording medium in a sub-scanning direction that is perpendicular to the main scanning direction; and the active light beam irradiation device has a structure in which the active light beam emission unit which emits the active light beam is divided into a plurality of parts in the scanning direction of the scanning device and includes a main curing device which is arranged to the downstream side of the inkjet head in terms of the direction of conveyance of the recording medium conveyance device and which cures ink droplets on the recording medium in such a manner that the ink droplets are fixed to the recording medium.

Furthermore, a desirable mode is one where, in an inkjet recording apparatus as described above, the inkjet head includes at least one nozzle row in which a plurality of nozzles are aligned in the sub-scanning direction, and the active light beam irradiation control device controls irradiation of the active light beam in such a manner that the divided units of the active light beam emission unit are switched on sequentially from the side having a shorter arrangement interval with respect to the nozzle row, and light emission of a divided unit of the active light beam emission unit is started at a timing where a time period determined by dividing the arrangement interval between the nozzle row and the divided unit of the active light beam emission unit by a scanning speed of the scanning device has elapsed from an ink ejection start timing of any one of the plurality of the nozzle rows.

Furthermore, in the inkjet recording apparatus described above, desirably, the active light beam irradiation control device controls irradiation of the active light beam in such a manner that the divided units of the active light beam emission unit are switched off sequentially from the side having a shorter arrangement interval with respect to the nozzle row, and light emission of a divided unit of the active light beam emission unit is halted at a timing where a time period determined by dividing the arrangement interval between the nozzle row and the divided unit of the active light beam emission unit by a scanning speed of the scanning device has elapsed from an ink ejection end timing of any one of the plurality of the nozzle rows.

Desirably, the main curing device has a structure in which a plurality of active light beam emission units are arranged in an opposite direction to a row of the nozzles.

According to this mode, irradiation of an active light beam onto the nozzles is prevented, and an active light beam is radiated reliably onto the image formation area only.

Desirably, the active light beam irradiation device includes a provisional curing device which is provided on an upstream side of the inkjet head in terms of a scanning direction of the scanning device and which is moved in the main scanning direction, together with the inkjet head, by the scanning device; and the active light beam irradiation control device starts light emission from the provisional curing device at a timing where a time period determined by dividing an arrangement interval between the provisional curing device and the nozzles by the scanning speed of the scanning device has elapsed from the ejection start timing of the nozzles.

According to this mode, irradiation of an active light beam can be controlled in synchronism with the ink ejection timing, by judging the start of irradiation of the active light beam by the provisional curing device on the basis of the elapsed time from the ink ejection start timing.

Desirably, the active light beam irradiation control device halts the light emission from the provisional curing device at a timing where a time period determined by dividing the arrangement interval between the provisional curing device and the nozzles by the scanning speed of the scanning device has elapsed from an ejection end timing of the nozzles.

According to this mode, irradiation of an active light beam is controlled in synchronism with the ink ejection timing, by judging the end of irradiation of the active light beam by the provisional curing device on the basis of the elapsed time from the ink ejection end timing.

Furthermore, in the inkjet recording apparatus as defined in any one of the above, desirably, the active light beam irradiation device includes a provisional curing device which is provided on the upstream side of the nozzle row in terms of the scanning direction of the scanning device and which moves in the main scanning direction due to the scanning device, together with the inkjet head; and the active light beam irradiation control device starts emission by the provisional curing device at a timing where a time period determined by dividing the arrangement interval between the nozzle row and the provisional curing device by the scanning speed of the scanning device has elapsed from the ejection start timing of the nozzle row.

Moreover, in an inkjet recording apparatus described above, desirably, the active light beam irradiation control device halts light emission by the provisional curing device at a timing where a time period determined by dividing the arrangement interval between the nozzle row and the provisional curing device by the scanning speed of the scanning device has elapsed from the ejection end timing of the nozzle row.

Desirably, when a length of a row of the nozzles in the sub-scanning direction is represented as $L_h$ and when a length over which the active light beam is emitted from the provisional curing device in the sub-scanning direction is represented as $L_l$, then a relationship $L_h<L_l$ is satisfied; and the irradiation control device controls the irradiation of the active light beam from the provisional curing device in such a manner that the irradiation of the active light beam from the provisional curing device is enabled while the inkjet head is operated for scanning in the sub-scanning direction number of times obtained by multiplying by $(L_l/L_h)$ number of multi-passes in the sub-scanning direction.

According to this mode, a virtually uniform active light beam is irradiated onto the ink droplets in the image formation area, even in cases where the length $L_h$ of the nozzle row in the sub-scanning direction and the length $L_l$ through which the active light beam of the provisional curing device is emitted in the sub-scanning direction satisfy the relationship $L_h<L_l$.

Desirably, the provisional curing device has a structure in which ultraviolet LED elements are arranged in the sub-scanning direction.

In this mode, desirably, the provisional curing device is divided in the sub-scanning direction, and the on/off switching of the active light beam (ultraviolet light beam) is controlled for each divided unit.

Another aspect of the invention is directed to an image forming method comprising: an ink ejection step of ejecting ink from nozzles onto a recording medium while causing relative movement between the recording medium and an inkjet head having the nozzles for ejecting the ink that is curable by irradiation of an active light beam; and an active light beam irradiation step of irradiating the ink which has been deposited onto the recording medium with the active light beam emitted from an active light beam emission unit divided into units in a direction of the relative movement while relative movement between the recording medium and the active light beam emission unit is caused along with the inkjet head in such a manner that when the ink deposited on the recording medium is irradiated with the active light beam, switching on or off the active light beam irradiation unit is performed with respect to each of the divided units sequentially in order of an alignment sequence in the direction of the relative movement, and the switching on the divided units of the active light beam emission unit is performed sequentially in order of reaching an image formation area on the recording medium and the switching off the divided units of the active light beam emission unit is performed sequentially in order of leaving the image formation area.

Desirably, in the ink ejection step, the inkjet head and the active light beam emission unit are moved in a main scanning direction, the recording medium is conveyed in a sub-scanning direction perpendicular to the main scanning direction, and the ink is ejected at a timing that the nozzles reach the image formation area; and in the active light beam irradiation step, the divided units of the active light beam emission unit are switched on sequentially from a side having a shorter arrangement interval with respect to the nozzles, and light emission of the divided units of the active light beam emission unit is started at a timing where a time period determined by dividing the arrangement interval between the nozzles and the divided units of the active light beam emission unit by a scanning speed in the main scanning direction has elapsed from an ink ejection start timing of the nozzles.

Desirably, in the active light beam irradiation step, the divided units of the active light beam emission unit are switched off sequentially from a side having a shorter arrangement interval with respect to the nozzles, and light emission of the divided units of the active light beam emission unit is halted at a timing where a time period determined by dividing the arrangement interval between the nozzles and the divided units of the active light beam emission unit by a scanning speed in the main scanning direction has elapsed from an ink ejection end timing of the nozzles.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

an inkjet head having nozzles which eject ink onto a recording medium, the ink being curable by irradiation of an active light beam;

a scanning device which moves the inkjet head in a main scanning direction;

a recording medium conveyance device which conveys the recording medium in a sub-scanning direction that is perpendicular to the main scanning direction;

a main curing device having an active light beam emission unit that emits the active light beam and is divided into units in the main scanning direction, the main curing device being arranged to a downstream side of the inkjet head in terms of a conveyance direction of the recording medium conveyance device, the main curing device irradiating the ink deposited on the recording medium with the active light beam while moving along with the inkjet head relatively to the recording medium;

an active light beam irradiation control device which controls on or off switching with respect to each of the divided units of the active light beam emission unit in terms of an alignment sequence of the divided units in the main scanning direction, and switches on the divided units of the active light beam emission unit sequentially in order of reaching an image formation area on the recording medium, and switches off the divided units of the active light beam emission unit sequentially in order of leaving the image formation area; and an ejection control device which controls ejection by the inkjet head in such a manner that ink ejection is started at a timing that the nozzles arrive at the image formation area, and the ink ejection is ended at a timing that the nozzles leave the image formation area, wherein the main curing device has a structure in which the divided units of the active light beam emission unit are arranged in an opposite direction to a row of the nozzles, wherein the active light beam irradiation control device controls irradiation of the active light beam in such a manner that the divided units of the active light beam emission unit are switched on sequentially from a side having a shorter arrangement interval with respect to the nozzles, and light emission of the divided units of the active light beam emission unit is started at a timing where a time period determined by dividing the arrangement interval between the nozzles and the divided units of the active light beam emission unit by a scanning speed of the scanning device has elapsed from an ink ejection start timing of the nozzles.

2. The inkjet recording apparatus as defined in claim 1, wherein the active light beam emission unit includes ultraviolet LED elements at least one of which is assigned to each of the divided units.

3. The inkjet recording apparatus as defined in claim 1, further comprising an image formation area prescribing device which prescribes the image formation area.

4. The inkjet recording apparatus as defined in claim 1, wherein the active light beam irradiation control device controls the irradiation of the active light beam in such a manner that the divided units of the active light beam emission unit are switched off sequentially from a side having a shorter arrangement interval with respect to the nozzles, and the light emission of the divided units of the active light beam emission unit is halted at a timing where a time period determined by dividing the arrangement interval between the nozzles and the divided units of the active light beam emission unit by the scanning speed of the scanning device has elapsed from an ink ejection end timing of the nozzles.

5. The inkjet recording apparatus as defined in claim 1, further comprising a provisional curing device which is provided on an upstream side of the inkjet head in terms of a scanning direction of the scanning device and which is moved in the main scanning direction, together with the inkjet head, by the scanning device, wherein the active light beam irradiation control device starts light emission from the provisional curing device at a timing where a time period determined by dividing an arrangement interval between the provisional curing device and the nozzles by the scanning speed of the scanning device has elapsed from the ink ejection start timing of the nozzles.

6. The inkjet recording apparatus as defined in claim 5, wherein the active light beam irradiation control device halts the light emission from the provisional curing device at a timing where a time period determined by dividing the arrangement interval between the provisional curing device and the nozzles by the scanning speed of the scanning device has elapsed from an ink ejection end timing of the nozzles.

7. The inkjet recording apparatus as defined in claim 5, wherein:

when a length of a row of the nozzles in the sub-scanning direction is represented as Lh and when a length over which the active light beam is emitted from the provisional curing device in the sub-scanning direction is represented as Ll, then a relationship Lh <Ll is satisfied; and the active light beam irradiation control device controls the irradiation of the active light beam from the provisional curing device in such a manner that the irradiation of the active light beam from the provisional curing device is enabled while the inkjet head is operated for scanning in the sub-scanning direction for a number of times obtained by multiplying a number of multi-passes in the sub-scanning direction by (Ll /Lh).

8. The inkjet recording apparatus as defined in claim 5, wherein the provisional curing device has a structure in which ultraviolet LED elements are arranged in the sub-scanning direction.

9. An image forming method comprising:

an ink ejection step of ejecting ink from nozzles onto a recording medium while moving an inkjet head in a main scanning direction, the inkjet head having the nozzles for ejecting the ink that is curable by irradiation of an active light beam;

a recording medium conveyance step of, correspondingly to the ink ejection step, conveying the recording medium in a sub-scanning direction that is perpendicular to the main scanning direction; and an active light beam irradiation step of irradiating the ink which has been deposited onto the recording medium with the active light beam emitted from a main curing device while moving the main curing device along with the inkjet head in the main scanning direction, the main curing device having an active light beam emission unit that emits the active light beam and is divided into units in the main scanning direction, the main curing device having a structure in which the divided units of the active light beam emission unit are arranged in an opposite direction to a row of the nozzles, the main curing device being arranged to a downstream side of the inkjet head in terms of a conveyance direction of the recording medium, in such a manner that when the ink deposited on the recording medium is irradiated with the active light beam, switching on or off the active light beam irradiation unit is performed with respect to each of the divided units sequentially in order of an alignment sequence in the main scanning direction, and the switching on the divided units of the active light beam emission unit is performed sequentially in order of reaching an image formation area on the recording medium and the switching off the divided units of the active light beam emission unit is performed sequentially in order of leaving the image formation area, wherein in the ink ejection step, the ink is ejected at a timing that the nozzles reach the image formation area; and in the active light beam irradiation step, the divided units of the active light beam emission unit are switched on sequentially from a side having a shorter arrangement interval with respect to the nozzles, and light emission of the divided units of the active light beam emission unit is started at a timing where a time period determined by dividing the arrangement interval between the nozzles and the divided units of the active light beam emission unit by a scanning speed in the main scanning direction has elapsed from an ink ejection start timing of the nozzles.

10. The image forming method as defined in claim 9, wherein in the active light beam irradiation step, the divided units of the active light beam emission unit are switched off sequentially from a side having a shorter arrangement interval with respect to the nozzles, and light emission of the divided units of the active light beam emission unit is halted at a timing where a time period determined by dividing the arrangement interval between the nozzles and the divided units of the active light beam emission unit by a scanning speed in the main scanning direction has elapsed from an ink ejection end timing of the nozzles.

* * * * *